United States Patent [19]

Ota

[11] 4,184,781

[45] Jan. 22, 1980

[54] DEFECT DETECTOR

[75] Inventor: Toshimichi Ota, Tokyo, Japan

[73] Assignee: Oki Electric Industry Co., Ltd., Tokyo, Japan

[21] Appl. No.: 894,711

[22] Filed: Apr. 10, 1978

[30] Foreign Application Priority Data

Apr. 19, 1977 [JP] Japan ..... 52/44100

[51] Int. Cl.[2] ..... B41J 3/10; B41J 29/46

[52] U.S. Cl. ..... 400/124; 400/54; 400/703

[58] Field of Search ..... 400/120, 124, 54, 695, 400/703; 346/76 PH; 219/216

[56] References Cited

U.S. PATENT DOCUMENTS

| | | | |
|---|---|---|---|
| 3,495,070 | 2/1970 | Zissen | 219/543 X |
| 3,500,437 | 3/1970 | Foerster | 400/703 X |
| 3,627,096 | 12/1971 | Finnegan | 400/124 |
| 3,710,913 | 1/1973 | Brennan | 346/76 PH X |
| 3,970,184 | 7/1976 | Helmrich et al. | 400/124 |

OTHER PUBLICATIONS

IBM Tech. Disc. Bulletin, F. W. Schaaf, "Serial Printer Error Correction", vol. 4, No. 11, Apr. 1962, pp. 14–15.

*Primary Examiner*—Paul T. Sewell

*Attorney, Agent, or Firm*—Peter L. Berger

[57] ABSTRACT

The present invention discloses a dot printer in which means are provided for detecting deterioration of dot print elements which print characters and so on and for detecting trouble caused by a print drive circuit. Print sensing elements are placed at a suitable point of a platen corresponding to a traverse range of dot print elements which are housed within a printing head and a mechanism for driving each dot print element is provided when said dot print elements move in front of the above-said print sensing elements sensing signal is generated when said dot print elements effect printing on the print sensing elements, to indicate the existence of trouble of the print drive circuit or dot print elements.

13 Claims, 16 Drawing Figures

DEFECT DETECTOR

BACKGROUND OF THE INVENTION

1. Field of the Invention

The present invention relates to a high-speed printer such as an impact-type dot printer or a thermal printer used in a terminal device of a computer, or more particularly, to a dot printer provided with means for detecting abnormal printing caused by a break of print wires which are employed for dot print elements or by the deterioration of thermal printing elements or by trouble of the print drive circuit which drives these print elements.

2. Description of the Prior Art

Dot printer represents a character, figure or a symbol with dots in a matrix form such as 5×7 and has configurations such as an impact-type dot printer and a thermal printer and so on. In these printers, printing quality deteriorates due to the omission of dots which form a character when a defect such as a break of print wires occurs in dot print elements which are composed of print wires or thermal printing elements. When the number of omitted dots is one or two, the deterioration of printing quality is difficult to visually detect because of the normal blur of the ink or thermal sensitive materials on a print paper and the minimal deterioration. For that reason, an operater often does not become aware of the deterioration of printing quality for a long while when above-described defects occur in the dot print elements and, in extreme cases, the deterioration becomes such that mechanical reading by an optical character reader is impossible. In addition, printing quality deteriorates due to trouble in the print drive circuit.

SUMMARY OF THE INVENTION

In the present invention, print sensing elements which are composed of piezo-electric elements are placed at a suitable point of a platen corresponding to a traverse range of dot print elements and means for driving each dot print element are provided when said dot print elements are in front of the above-said print sensing elements. After amplifying and shaping a print sensing signal which is generated when said dot print elements hit the print sensing elements, the existence of defects in printing of each dot print elements is determined by sampling the print sensing signal by a printing head position signal from a printing head position detector.

It is therefore an object of the invention to stabilize the printing quality through detecting in advance the partial omission of dots which form a character and so on.

It is another object of the invention to stabilize as well as improve the printing quality through detecting immediately an abnormal printing caused by a break of print wires which are employed for dot print elements or by a trouble of thermal printing elements by the provision of print sensing elements which are provided in proportion to the number and arrangement of dot print elements.

It is further object of the invention to sense the above-said defects with a simplified circuit by providing a counter for driving successively the dot print elements and, moreover, print sensing elements for sensing the printing action of said dot print elements.

The above and further objects and novel features of the invention will more fully appear from the following detailed description when the same is read in connection with the accompanying drawings. It is to be expressly understood, however, that the drawings are for purpose of illustration only and are not intended as a definition of the invention.

BRIEF DESCRIPTION OF THE INVENTION

Figure 2:
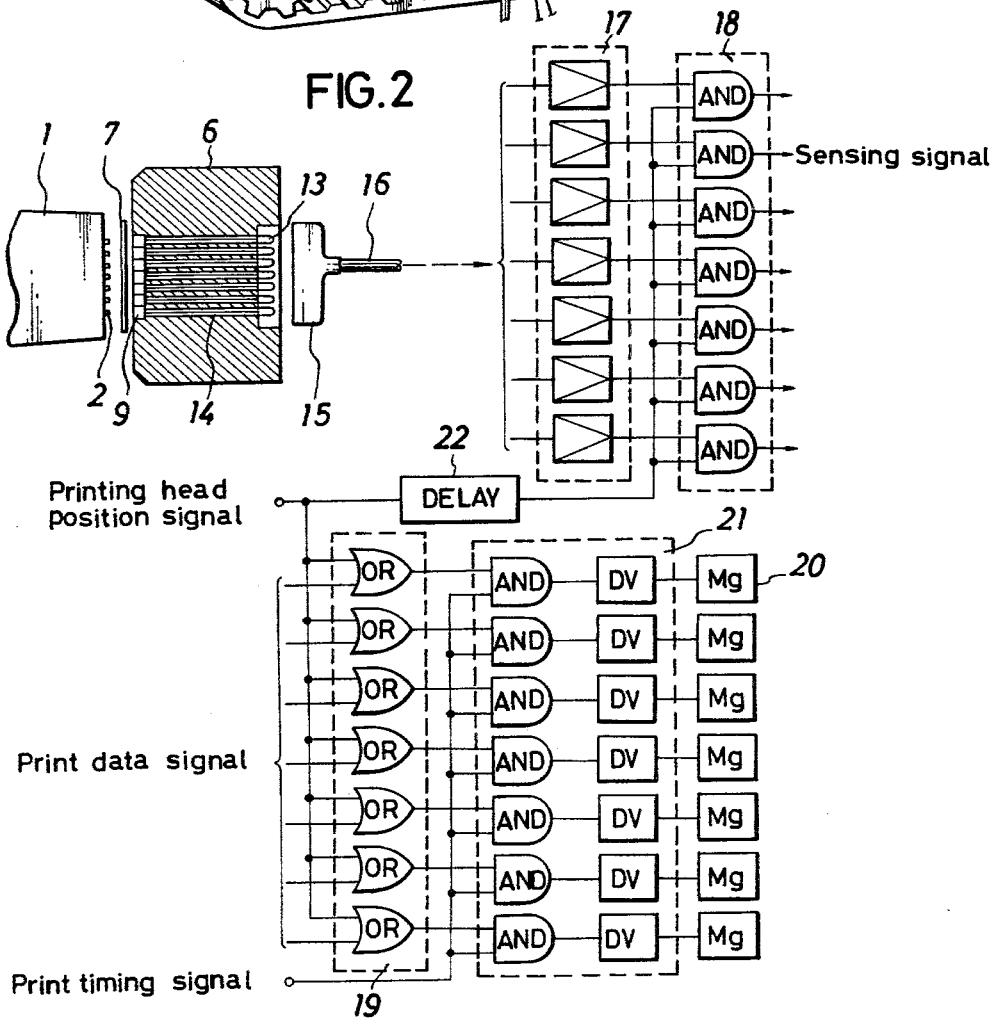
FIG. 2 is a circuit diagram in which is shown a circuit for sensing the existence of defects in printing as well as illustrating print sensing elements which are placed in a platen.

FIGS. 3*a* through 3*g* are waveform charts of the circuit in FIG. 2.

Figure 4:
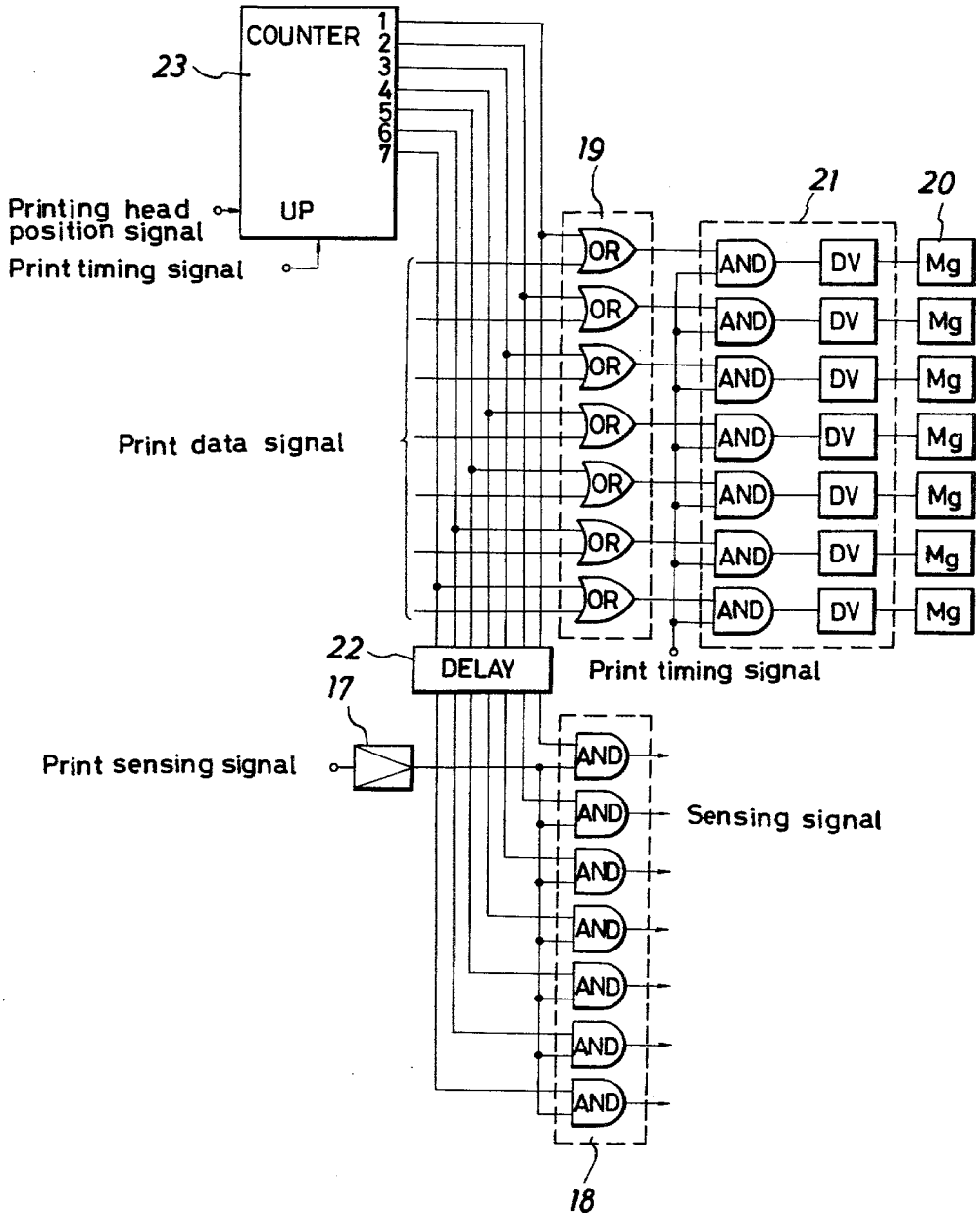

FIG. 4 is a circuit diagram by which print wires which are employed for dot print elements are driven succesively one by one.

FIGS. 5*a* through 5*f* are waveform charts of the circuit in FIG. 4.

DETAILED DESCRIPTION OF THE PREFERRED EMBODIMENTS

Figure 1:
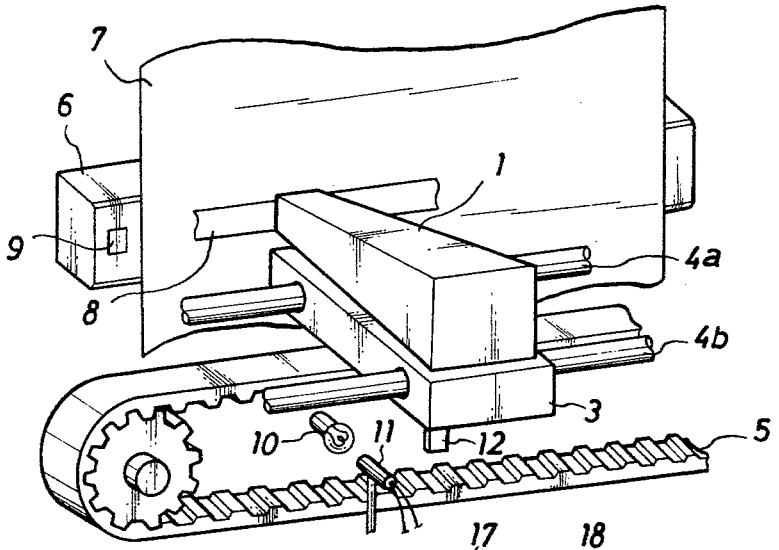
FIG. 1 is a perspective view in which schematically shown an embodiment of the dot printer defect detector according to the present invention.

Referring now to FIG. 1 in which schematically shown is an embodiment of dot printer according to the present invention, the construction of the dot printer is described hereinafter on the basis of the figure. Print wires 2 which are employed for dot print elements (see FIG. 2) as well as solenoids (not shown) which drive said print wire 2 are housed within a printing head 1 and a carriage 3 on which said printing head 1 is mounted is traversed in a horizontal direction by a spacing belt 5 under the guidance of guide shafts 4*a* and 4*b*. A platen 6 is provided on the opposite side of said printing head 1 and a printing paper 7 as well as an ink ribbon 8 are situated between the platen 6 and the printing head 1. The traverse range of the printing head 1 is between a home position (i.e. the initial starting position) and a right boundary position in accordance with the printing width of the printing head 1 and printing is carried out by the reciprocal movement of the print wires 2 to the platen 6. In a traverse range of the printing head 1, namely between the home position and the right boundary position, print sensing elements 9 which are composed of piezo-electric elements are placed on the platen 6 corresponding to the home position. Said print sensing elements are hit by print wires 2 which are employed for dot print elements as a variation of current and are provided independently in proportion to the number and arrangement of said print wires 2. Numeral 10 indicates a light source which is provided corresponding to the position of print sensing elements 9. Numeral 11 indicates a printing head position detector which is opposite the light source 10. A shield plate 12 connected to carriage 3 will come to the position between above-said printing head position detector 11 and the light source 10 when the printing head 1 is opposite to of the print sensing elements 9, and the light is shielded to generate a printing head position signal which will be hereinafter described.

In the next place, means for sensing the existence of defects in printing of print wires 2 which are employed for dot print elements in the dot printer with the print sensing elements 9 is described with reference to the circuit diagram of FIG. 2.

As schematically shown in FIG. 2, the print sensing elements 9 which are provided independently in proportion to the number and arrangement of print wires 2 are connected with pin terminals 13 which are situated behind the platen 6 and a print sensing signal of said print sensing elements is fed into and amplifying and shaping circuit 17 via a connector 15 and a cable 16 and further supplied to one input of an AND gate 18. A printing head position signal (see FIG. 3*a*) is generated by the printing head position detector 11 (shown in FIG. 1) when the print wires 2 come in front of the print sensing elements 9 and said printing head position signal is distributed via an OR gate 19 to a print drive circuit 21 for driving magnets 20 of solenoids which are provided for driving each print wires 2.

Therefore, said print drive circuit 21 may be driven by either a print data signal which specifies a character or the abovesaid printing head position signal by the function of above-said OR gate 19, and the print drive circuit 21 actuates the magnet 20 of print wires 2 by a print wire drive signal (see FIG. 3*c*) in synchronism with a print timing signal (see FIG. 3*b*) which actuates the print timing and, in this way, printing is carried out. Accordingly, the print wires 2 are driven each time the printing head 1 comes in front of the printing head position detector 11 in addition to the printing on the printing paper 7 by the print data signal and the print wires 2 hit above-said print sensing elements 9 each time before commencing the printing of a new print line.

Figure 3:
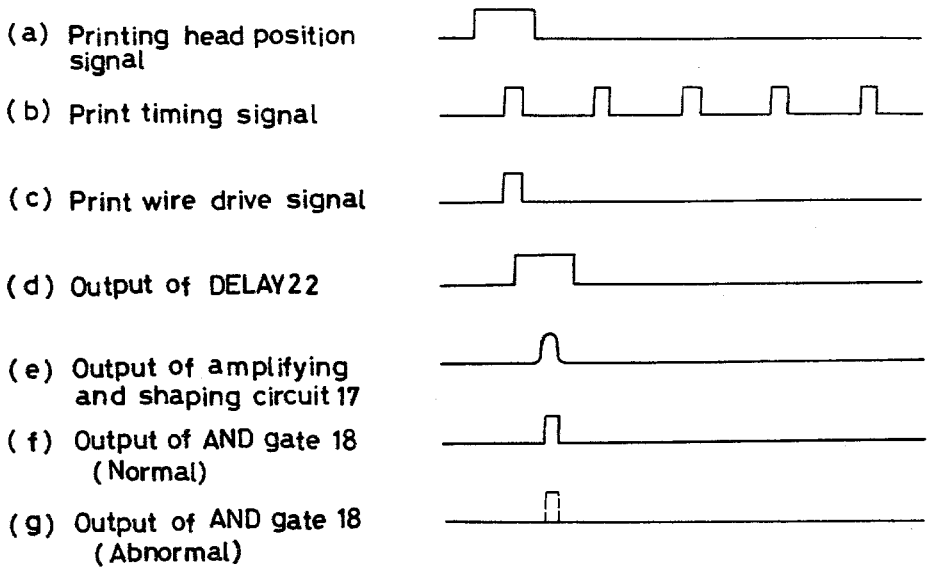
Figure 5:
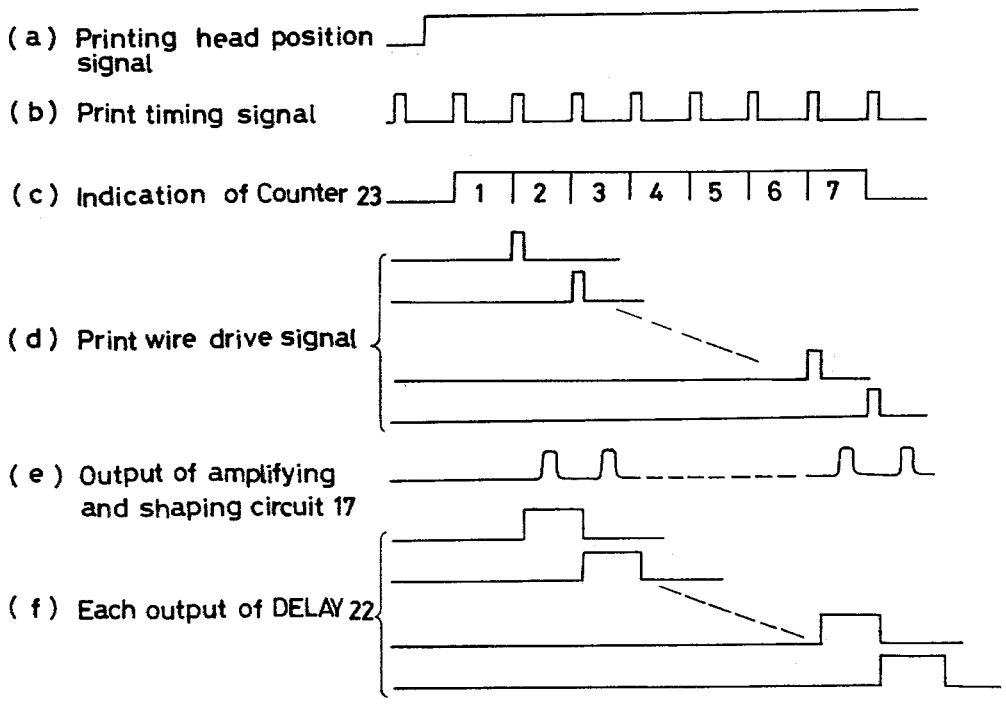

The above-described hits of the print wires 2 are perceived by the print sensing elements 9 and a print sensing signal (see FIG. 3*e*) is fed to the AND gate 18. The printing head position signal which is generated by the printing head position detecter 11 is also fed to the AND gate 18 after being delayed by a delay 22 just for the time that it takes the print wires 2 hit the print sensing elements 9, and the printing head position signal samples the print sensing signal at the AND gate 18. Each sensing signal which is obtained after sampling indicates, in case of FIG. 3*f*, that there are no defects in printing. In case that the sensing signal is not detected, as shown in FIG. 3*g*, it indicates that there are defects in printing in the print wires 2 which correspond to said print sensing elements 9. An alarm circuit may be provided to alarm in such a case as described above or a lamp may be provided. Moreover, the lamp may be provided to designate the print wire 2 from which the sensing signal cannot be obtained.

As described above, the dot printer according to the present invention indicates the dot print element which has a defect in printing on account of the break of the print wire 2, therefore, such a defect which is difficult to be found out can be detected in an early stage to minimize the degradation of the printing quality. In addition, an opportunity for clarifying the cause of the defect can be obtained to stabilize and improve the printing quality. In the above-described embodiment, print sensing elements 9 are near the home position of the printing head 1. It is not necessary to do so, and the print sensing elements 9 may be placed anywhere in the traverse range of the printing head 1 except at a place for the printing paper 7, but if one dot column may be printed on the printing paper 7, the print sensing elements 9 may be placed at the place for the printing paper 7.

In above-described embodiment, the print wires 2 which are employed as the dot print elements are driven all at once to produce the sensing signal for indicating the existence of the defects in printing. Said print wires 2 also may be driven successively one by one, and such embodiment is described hereinunder with reference to FIG. 4. As noted previously, the printing head position detector 11 generates the printing head position signal (see FIG. 5*a*) to energize a counter to count up when the printing head 1 moves in front of the print sensing elements 9. Said printing head position signal has a duration longer than the one shown in FIG. 3*a*, because the print wires 2 are driven successively one by one. The counter 23 counts up the print timing signal (see FIG. 5*b*) during the time the printing head position signal is fed and distributes the print wire drive signal (see FIG. 5*d*) in turn from the first print wire 2 to drive the print wire 2 in accordance with the counted value, namely the indication of the counter 23 (see FIG. 5*c*). In the present embodiment, the print sensing signal which is generated by the hit of print wires 2 can be generated by one print sensing element 9 which is common to each print wire 2. The print sensing signal (see FIG. 5*e*) which has been amplified and shaped by one amplifying and shaping circuit 17 which is common to each print wires 2 is fed to the input of AND gate 18 and sampled therein by the output signal of the counter 23 which has been delayed by the delay 22 and finally the sensing signal which corresponds to each print wires 2 can be obtained. The above-described sensing signal which is generated by the impact of print wires 2 indicates, as the foregoing embodiment, the existence of defects in printing of print wires 2. With the present embodiment, the number of print sensing elements 9 and the composition of the circuit can be simplified.

In the above description, references have been made to the impact-type dot printers, whereas the present invention is also applicable to a thermal printer in which thermoelectric elements are employed for the print sensing elements. The present invention is further applicable to a printer in which the dot print elements are arranged in a matrix form. In such a printer, the print sensing elements are provided in the matrix form in accordance with an arrangement of said dot print elements and the AND gates for sampling the print sensing elements are those required for the total number of dot print elements as the foregoing embodiment.

While there have been shown and described and pointed out the fundamental novel features of the invention as applied to preferred embodiments, it will be understood that the various omissions and substitutions and changes in the form and details of the mechanism illustrated and in its operation may be made by those skilled in the art without departing from the spirit of the invention.

What is claimed is:

1. In a dot printer employing a movable print head including movable print elements to effect printing paper, a printing platen located opposite said print head with said printing paper being located between said print head and printing platen, said print head movable across said platen from a home position to a right boundary position, an improvement comprising a dot printer defect detector comprising means for moving said movable print elements to their print positions;

means to sense the impact of said movable print elements moving to their print positions;

means to detect if any of said movable print elements fail to move to said print position; and indicating means to indicate when any of said movable print elements fail to move to said print position.

2. The invention as claimed in claim 1, wherein said indicating means comprises alarm means.

3. The invention as claimed in claim 1, wherein said indicating means comprises light means, said light means further indicating which of said movable print elements fails to move to its print position.

4. The invention as claimed in claim 1, wherein said indicating means operates prior to a line being printed on said papers by said print head.

5. The invention as claimed in claim 1, wherein said means to sense comprises print sensing elements located on said platen to be struck by said print elements, and said means to detect comprises a drive mechanism for driving said dot print elements when said dot print elements move in front of said print sensing elements.

6. The invention as claimed in claim 5, wherein the number and arrangement of said print sensing elements are related to the number and arrangement of said dot print elements.

7. The invention as claimed in claim 5, wherein said drive mechanism comprises means to generate a print head position signal and said dot print elements are simultaneously moved by the generation of said print head position signal.

8. The invention as claimed in claim 5, wherein said means to detect further comprises a print head position detector and a light source located opposite therefrom, said print head being carried on a carriage, and light blocking means connected to said carriage to block the light from impinging on said print head position detector from said light source to actuate said drive mechanism.

9. The invention as claimed in claim 5, wherein said print sense elements are located on said platen corresponding to the home position of said print head.

10. The invention as claimed in claim 5, wherein said print sense elements comprise piezo-electric elements.

11. The invention as claimed in claim 5, wherein said drive mechanism comprises means to generate a print head position signal which causes said dot print elements to impact said print sense elements, said print sense elements generating respective signals upon being impacted, and sampling means for sampling the print sense elements to determine if said respective signals are generated.

12. The invention as claimed in claim 11, wherein said sampling means comprises a plurality of two-input AND gates, one input of each of said AND gates being connected to receive a respective one of said respective signals, and delay means connected between said print head position signal and the second inputs of said AND gates so that said second inputs receive said delayed signal during the time that said respective signals are being generated.

13. The invention as claimed in claim 12, further comprising counter means, wherein each of said dot print elements is successively driven, said counter means receiving said printing head position signal and a timing signal and generating successive counts to enable said dot print elements to be successively driven.

* * * * *